US007150612B2

(12) United States Patent
Komatsu et al.

(10) Patent No.: US 7,150,612 B2
(45) Date of Patent: Dec. 19, 2006

(54) GEAR PUMP OR MOTOR

(75) Inventors: Koji Komatsu, Otsu (JP); Nobuo Mukai, Otsu (JP); Takumi Ishihara, Kusatsu (JP); Yoshiyuki Hirose, Otsu (JP)

(73) Assignee: Shimadzu Corporation, Kyoto (JP)

( * ) Notice: Subject to any disclaimer, the term of this patent is extended or adjusted under 35 U.S.C. 154(b) by 233 days.

(21) Appl. No.: 10/854,325

(22) Filed: May 26, 2004

(65) Prior Publication Data

US 2004/0241031 A1 Dec. 2, 2004

(30) Foreign Application Priority Data

Jun. 2, 2003 (JP) ..... 2003-157018
Mar. 17, 2004 (JP) ..... 2004-076185

(51) Int. Cl.
*F01C 1/18* (2006.01)

(52) U.S. Cl. ..... 418/206.1; 418/206.4; 418/134

(58) Field of Classification Search ..... 418/206.1, 418/206.2, 206.3, 206.4, 206.5, 206.6, 134
See application file for complete search history.

(56) References Cited

U.S. PATENT DOCUMENTS 3,076,413 A * 2/1963 Hoffer ..... 418/1
3,113,524 A * 12/1963 Fulton ..... 418/79
4,940,394 A * 7/1990 Gibbons ..... 417/283
5,052,905 A * 10/1991 Rustige ..... 418/132
5,496,163 A * 3/1996 Griese et al. ..... 418/200
5,692,888 A 12/1997 Truninger
6,991,442 B1 * 1/2006 Meguro ..... 418/182

FOREIGN PATENT DOCUMENTS

JP A-8-121351 5/1996

* cited by examiner

*Primary Examiner*—Hoang Nguyen
(74) *Attorney, Agent, or Firm*—Rankin, Hill, Porter & Clark LLP

(57) ABSTRACT

A gear•rear shaft containing main body of a bottomed type is penetrated with a bearing hole and a rear face of the gear•rear shaft containing main body is coupled with a closing plate to form an airtight seal from an outside environment. Shafts extended from two gears to a side of the rear face are set to be shorter than a length of the bearing hole in an axis core direction. Bushes are also set to a length that is the same as that of the shafts. The gear•rear shaft containing main body is formed with a recess portion at the rear face and the bearing hole is penetrated to open to the recess portion. The gear•rear shaft containing main body is bored to penetrate with a low pressure port communicating with a low pressure region in an axis core direction.

9 Claims, 5 Drawing Sheets

GEAR PUMP OR MOTOR

BACKGROUND OF THE INVENTION

1. Field of the Invention

The present invention relates to a gear pump or motor of a circumscribing type usable in a field of hydraulic apparatus or the like.

2. Description of the Related Art

A gear pump or motor of this kind is provided with a pair of gears brought in mesh with each other, shafts respectively extended from front and rear sides in axis center directions of the gears, and a pump main body containing these, for making a hydraulic fluid (oil) flow from a high pressure region of a meshed portion to a low pressure region of other meshed portion by rotating the two gears. According to the gear pump or motor, the pump main body is constituted by a front shaft containing main body for containing the shafts on a front side, a gear containing main body for containing the gears and a rear shaft containing main body for containing the shafts on a rear side.

There are three kinds of types of combining constituent elements of the pump main body as follows. A first type is a type of coupling the front shaft containing main body, the gear containing main body and the rear shaft containing main body to each other respectively as separate members, a second type is a type of integrating the front shaft containing main body and the gear containing main body, and a third type is a type of integrating the gear containing main body and the rear shaft containing main body. A pump main body integrated with the gear containing main body and the rear shaft containing main body is referred to as a 'gear•rear shaft containing main body' as follows and the type achieves advantages of reducing a number of parts in comparison with a constitution separately constituting the respective main bodies, facilitating to install a comparatively large suction port (low pressure) or delivery port (high pressure) at a side face of the main body and is reduced to practice (refer to, for example, JP-A-08-121351).

The gear•rear shaft containing main body is constituted by a bottomed shape and the bottom is installed with a bearing hole and it is necessary that high pressure is not generated at the depth portion. For that purpose, the depth portion of the bearing hole is communicated with the low pressure region (for example, suction port) Specifically, there is carried out a measure or the like of forming communicating means for communicating a face of the rear shaft containing main body brought into contact with the depth portion, that is, a region at a rear face of the rear shaft containing main body to the low pressure region and forming a communicating path for communicating bearing portions of the two gears to the low pressure region.

For example, according to a type of forming a low pressure communicating path by boring an inclined hole from a side of the gear containing main body and boring a hole for communicating to low pressure at an inner peripheral face of the bearing portion by recessing, a surrounding of the bearing hole is subjected to countersinking in an elliptical shape, the bearing is integrated by constituting a projected height slightly lower than a depth of the countersinking and a seal member is caught by an outer side thereof. Further, a hole communicating with a low pressure portion is bored at an inner portion subjected to the countersinking and a spacer for hampering deformation of the seal member by a negative pressure is inserted thereto. Further, when the pump main body is fabricated by a die cast system, there is carried out a method of previously forming a groove at a portion of the main body and connecting the groove to the low pressure communicating path.

However, according to the method of forming the low pressure communicating path by the inclined hole, a long slender hole needs to bore, time is taken for the working, further, a hole bored on the side of the pump main body must be closed. Further, recessing requires time and labor in working. Also the method of previously forming a die requires a working time period and a problem is posed in working accuracy. Further, according to the method of forming the low pressure communicating path by the inclined hole, the long slender hole needs to bore, time is taken in the working, further, the hole bored on the side of the pump main body needs to close. Further, also recessing is operation taking time in working and requiring labor. Also the method of previously forming the die at the cast product poses a problem that a working time period is required and working accuracy is low. Further, a consideration is taken in the projected height in integrating the bearing, the portion does not function as the bearing and therefore, an extra bearing length is needed and a cost is increased.

SUMMARY OF THE INVENTION

It is an object of the invention to provide a gear pump or motor having a simple constitution capable of reducing a number of parts.

In order to achieve the above-described object, a gear pump or motor comprises:

a pair of gears brought in mesh with each other;

shafts extending from front and rear sides of the gears in axis core directions of respective the gears;

a pump main body containing the gears and the shafts, the pump main body including a rear shaft containing main body with bearing holes for containing to support the shafts on the rear sides of the gears so that the bearing holes are formed to penetrate a rear face of the rear shaft containing main body; and a closing plate for attaching to the rear face of the rear shaft containing main body to seal a rear face region of the rear shaft containing main body in airtight from outside, the rear face region including the bearing holes and surroundings of the bearing holes, wherein a hydraulic fluid is made to flow from a high pressure region to a low pressure region of a mesh portion of the two gears.

Further, the invention is characterized in the following three constitutions based on the above-described constitution. A first constitution is constituted by a gear•rear shaft containing main body integrated with a gear containing main body and the rear shaft containing main body. A second constitution is formed with a seal member interposed between a closing plate and the rear shaft containing main body for sealing in airtight in a ring-like shape. A third constitution is formed with an inserting groove of the seal member at the closing plate to fixedly hold the seal member. By the constitutions, a seal mechanism on a side of the rear shaft containing main body is simplified, further, working of a hole for communicating the bearing hole and the low pressure region is dispense with. Further, also a number of parts is reduced.

The gear pump or motor provided by the invention is as described above in details and therefore, the following effects are achieved.

(1) A shape and a constitution of the rear shaft containing main body (including the gear•rear shaft containing main body in illustrated examples, the same as follows) is extremely simplified, the constitution of the gear pump or motor can be simplified, working thereof is facilitated and a reduction in cost can be achieved.

(2) The rear face of the rear side containing main body can be shielded by the closing plate in airtight from outside, the constitution of the gear pump or motor is simplified, working thereof is facilitated and a reduction in cost can be achieved.

(3) The low pressure region can easily be communicated with a rear face space of the rear side containing main body, working thereof is facilitated and a reduction in cost can be achieved. Further, multiple series pump formation is facilitated.

(4) An economical gear pump or motor is provided by the above-described various characteristics.

DETAILED DESCRIPTION OF THE INVENTION

An explanation will be given of a gear pump or motor provided by the invention in accordance with an embodiment shown in FIG. 1 through FIG. 3 as follows. According to the embodiment, a best mode is a constitution in which a gear•rear shaft containing main body integrated with a gear containing main body and a rear shaft containing main body is made to constitute an essential constituent element of a pump main body 1.

EMBODIMENT 1

Figure 1:
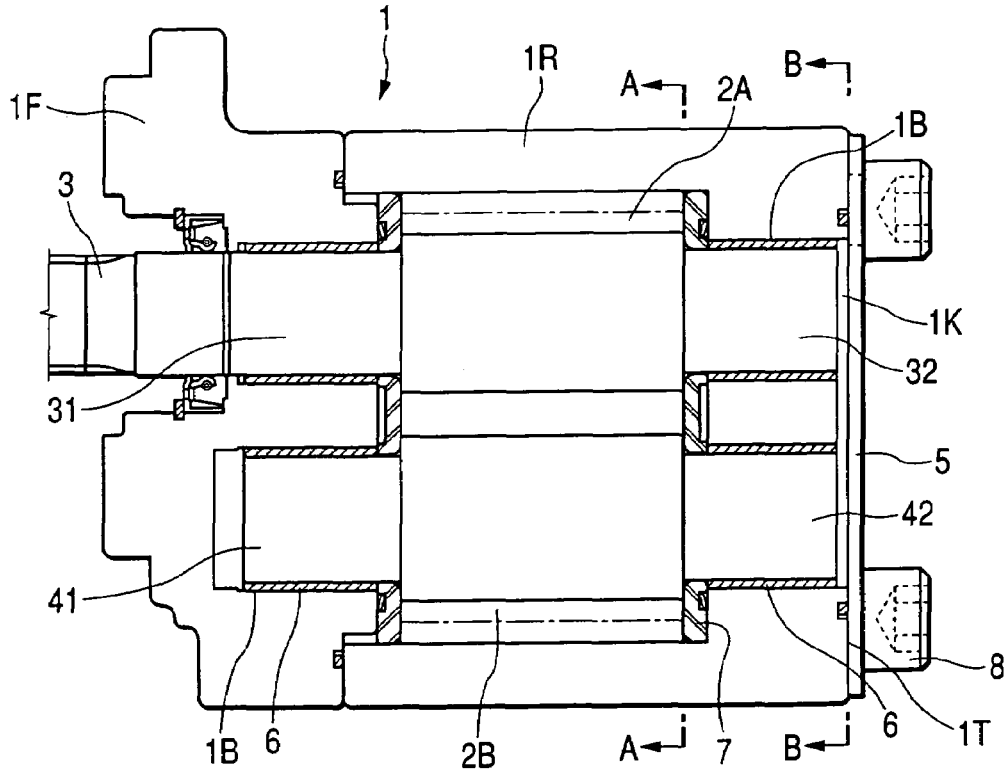
FIG. 1 is a vertical sectional view showing a constitution of the invention.
Figure 2:
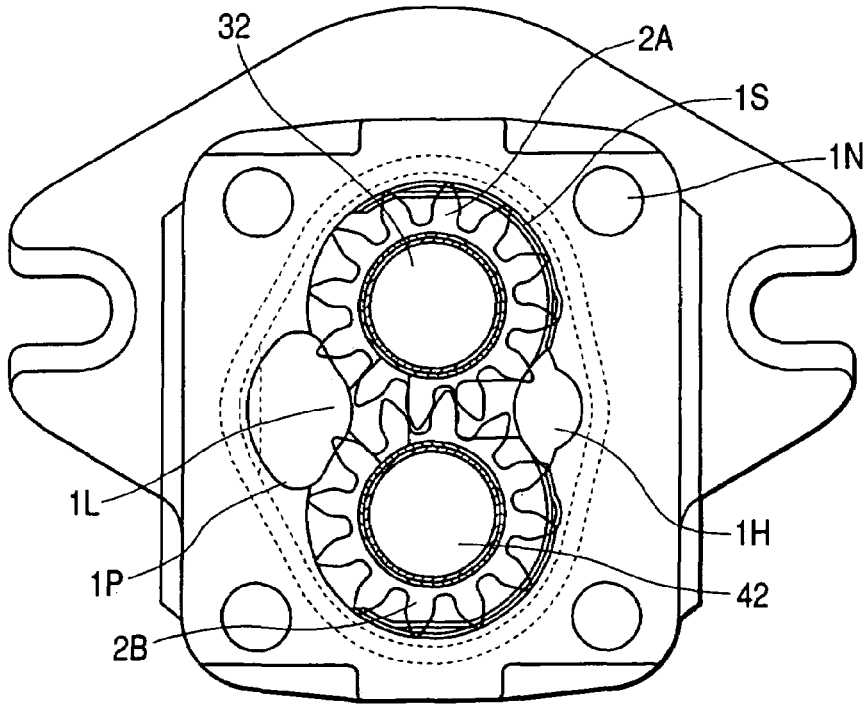
FIG. 2 is a view showing the constitution of the invention and is a view showing an A—A face of FIG. 1.
Figure 3:
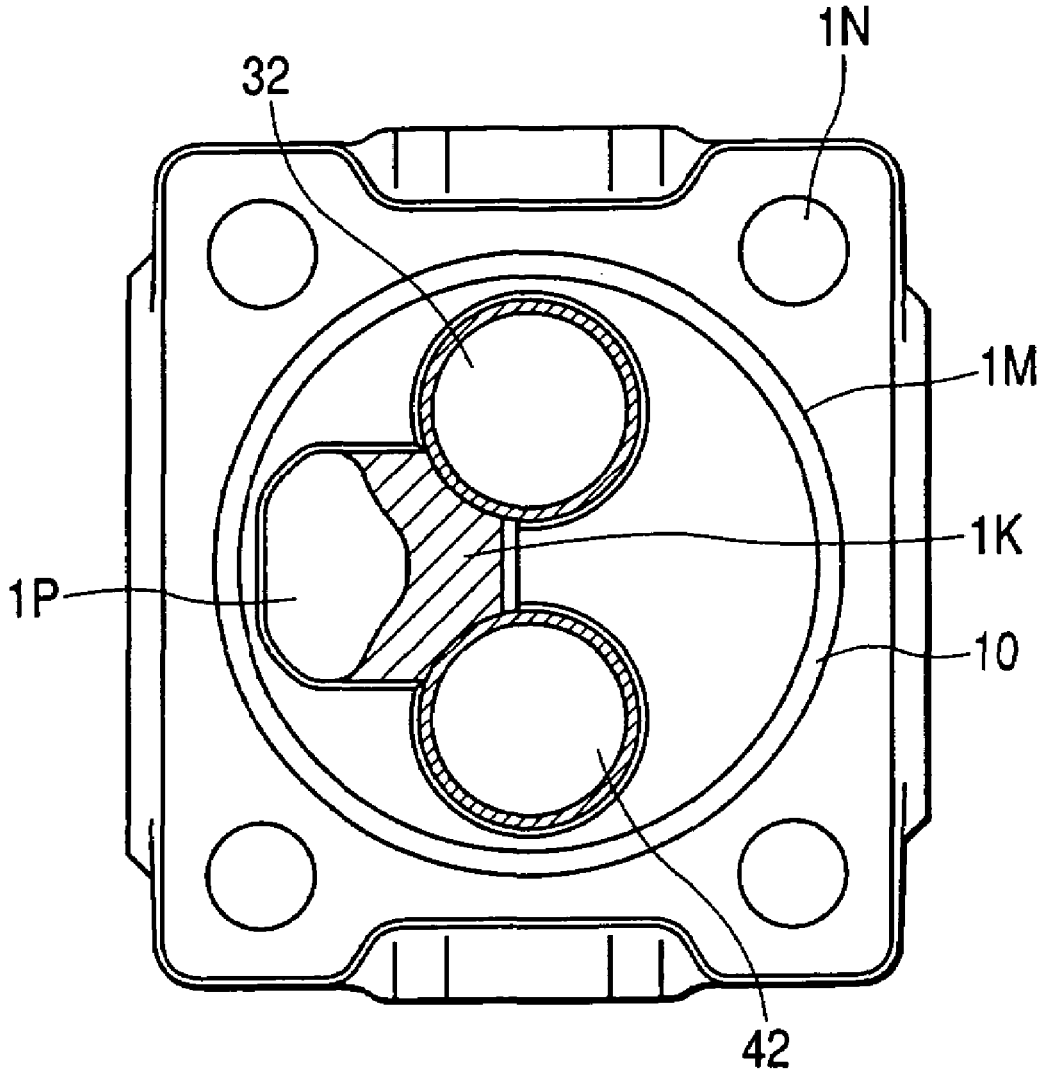
FIG. 3 is a view showing the constitution of the invention and is a view showing a B—B face of FIG. 1.

A first embodiment provided by the invention is shown in FIG. 1 through FIG. 3. First, FIG. 1 shows a basic constitution of a gear pump or motor by a vertical sectional view. The pump main body 1 comprises a front shaft containing main body 1F, and a gear•rear shaft containing main body 1R integrated with a gear containing main body for containing gears 2A, 2B and a rear shaft containing main body and a pair of the gears 2A, 2B are contained at inside thereof. The respective gears 2A, 2B are extended with shafts 31, 32 and 41, 42 respectively from front and rear sides in axis center directions thereof and among them, the shafts 31 and 41 are supported by bushes 6 installed at bearing holes 1B formed at the front shaft containing main body 1F and the shafts 32, 42 on rear sides thereof are supported by bushes 6 installed at bearing holes 1B formed at the gear•rear shaft containing main body 1R. The shaft 31 is integral with a shaft 3 penetrating the front shaft containing main body 1F. The shaft 3 becomes an input shaft of a rotationally driving force when the shaft 3 functions as a pump and becomes an output shaft of the rotationally driving force when the shaft 3 functions as a motor. Further, in FIG. 1, numeral 7 designates a side plate arranged to couple to respective sides of the two gears 2A, 2B for preventing leakage of a hydraulic fluid from sides of the gears 2A, 2B.

As shown by FIG. 2 showing an A—A face of FIG. 1, inside of the gear•rear shaft containing main body 1R is formed with a containing space 1S capable of containing the pair of respective gears 2A, 2B in a meshed state and the pair of respective gears 2A, 2B are contained at inside thereof. Further, the hydraulic fluid confined at an interval between the gear•rear shaft containing main body 1R and the respective gears 2A, 2B in the meshed state, that is, between teeth thereof is made to flow between a low pressure region 1L and a high pressure region 1H formed at the containing space 1S by rotating the two gears 2A, 2B to function as a pump or a motor. In the case of the pump, the low pressure region 1L is connected to a flow inlet of the hydraulic fluid and the high pressure region 1H is communicated to a delivery port. Further, in the case of functioning as the motor, the high pressure region 1H is communicated with the flow inlet of the pressurized oil and the low pressure region 1L is connected to a flow outlet of the hydraulic fluid.

According to the invention, in the above-described constitution, as shown by FIG. 1, the gear•rear shaft containing main body 1R is constituted by a bottomed shape and is basically characterized in that the bearing hole 1B formed at the gear•rear shaft containing main body 1R is constituted by a penetrating shape. Further, in order to seal a rear face 1T of the gear•rear shaft containing main body 1R formed in the open type in airtight from outside, a closing plate 5 is coupled to the rear face 1T. The shafts 32, 42 extended from the two gears 2A, 2B in a direction of the rear face 1T of the rear shaft containing main body 1R are set to be more less shorter than a length of the bearing holes 1B in an axis core direction thereof. Similarly, the respective bushes 6 are also set with a length the same as that of the shafts 32, 42. Therefore, the gear•rear shaft containing main body 1R is constituted by a shape in which a recess portion 1K is formed at the rear face 1T and the bearing hole 1B is penetrated and opened to the recess portion 1K. As shown by FIG. 3 showing a B—B face of FIG. 1, the recess portion is formed with a region at the rear face 1T of the gear•rear shaft containing main body 1R including the bearing holes 1B of the shafts 32, 42 and surroundings of the two bearing holes 1B.

On the other hand, the gear•rear shaft containing main body 1R is formed with a low pressure port 1P communicating with the low pressure region 1L, further, the low pressure port 1P is bored to penetrate in the axis core direction of the gear•rear shaft containing main body 1R and an entire region of the recess portion 1K is communicated with the low pressure region 1L. The recess portion 1K is an example of a specific constitution of a 'communicating path' specified in the scope of claims. There is provided the closing plate 5 for sealing the region of the rear face 1T of the gear•rear shaft containing main body 1R including the bearing holes 1B of the two shafts 32, 42 on the rear sides and the surroundings of the two bearing holes 1B in airtight from outside. By coupling the closing plate 5 to the rear face 1T of the gear•rear shaft containing main body 1R, inside of the pump main body 1 is shielded in airtight from outside. Further, a seal member 10 for sealing an interval between the closing plate 5 and the gear•rear shaft containing main body 1R in airtight is formed in a ring-like shape. Notation 1M designates a groove in a ring-like shape formed at the gear•rear shaft containing main body 1R. The seal member 10 is inserted to provide at the ring-like groove 1M and is interposed between the closing plate 5 and the gear•rear shaft containing main body 1R. Numeral 8 designates a fixing piece for coupling to the rear face 1T of the gear•rear shaft containing main body 1R. In FIG. 3, notation 1N designates a hole for penetrating the fixing piece 8 bored at the rear face 1T of the gear•rear shaft containing main body 1R. A space at the rear face 1T of the gear•rear shaft containing main body 1R is shielded in airtight from outside. Further, the low pressure port 1P is opened to the airtight space and therefore, the hydraulic fluid leaked to the space is made to flow to the low pressure region 1R at the low pressure port 1P.

EMBODIMENT 2

Figure 4:
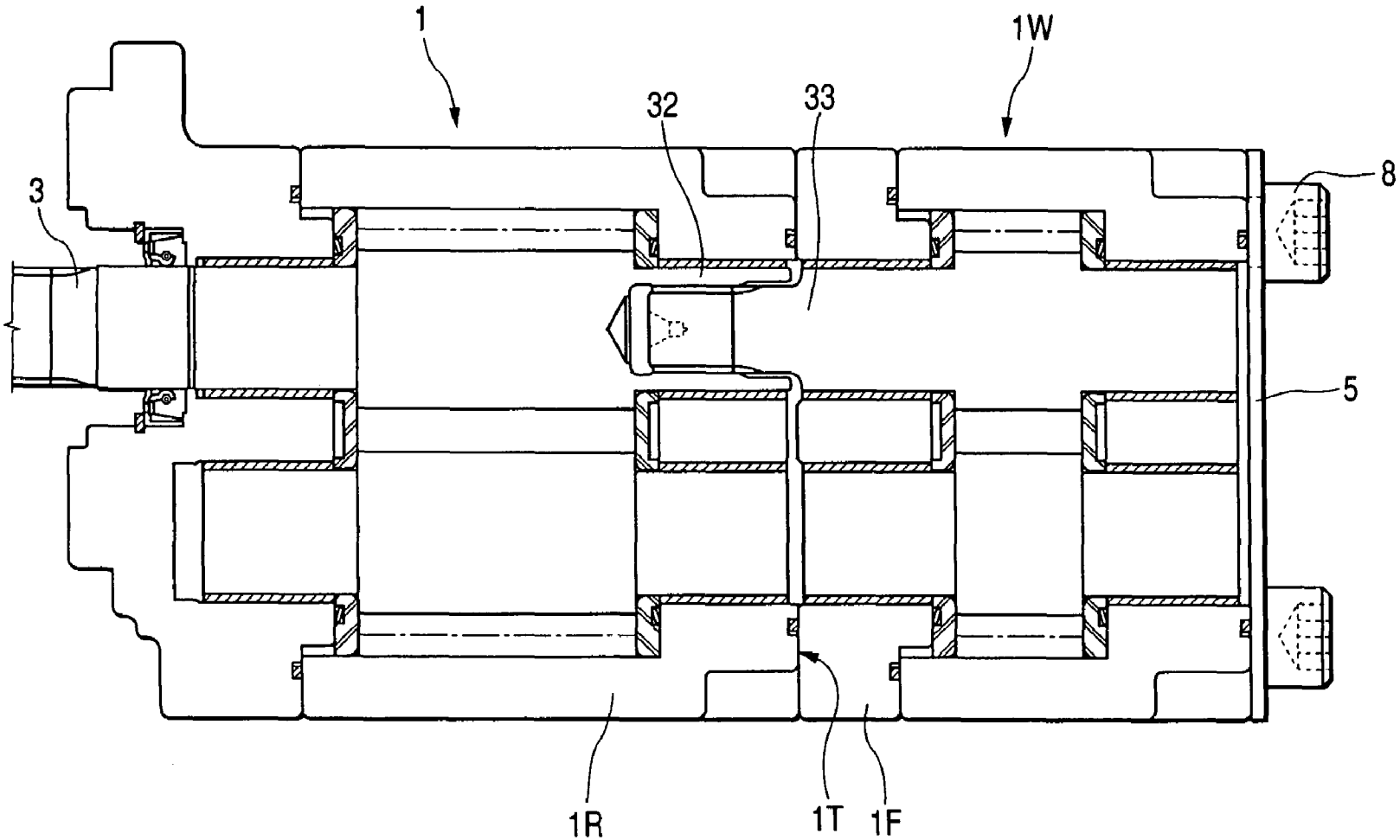
FIG. 4 is a vertical sectional view showing a constitution of an embodiment of the invention.

The invention is applicable to a multiple series type and FIG. 4 shows an example of a two series type which is an example of the multiple series type.

As shown by FIG. 4, the pump main body 1 of a first series and a pump main body 1W of a second series are fitted together to couple. The rear face 1T of the gear•rear shaft containing main body 1R of the pump main body 1 of the first series and a front face of the front shaft containing main body 1F of the pump main body 1W of the second series are respectively formed with a recess and a protrusion fitted to each other to thereby couple the two members. In this case, the fixing piece 8 shown in the embodiment of FIG. 1 is constituted to be long for the two series. Further, as shown by FIG. 4, the shaft 32 and a shaft 33 are coupled by a spline.

Therefore, when the rotational drive force is inputted from the shaft 3, also a pump of the second series is driven to function as the pump. In this case, formation of flow paths of flow in and flow out of the hydraulic fluid can be constituted by respectively separate types, or can be constituted by a joint flow type. Further, also in the second embodiment, a low pressure port (1P in FIG. 2, FIG. 3 although not illustrated) is bored by respectively penetrating the pump main body 1 of the first series and the pump main body 1W of the second series. However, only one sheet of the closing plate 5 is sufficient. In FIG. 4, members of notations designated by notations the same as the notations in FIG. 1 through FIG. 3 are provided with functions the same as those of the members shown in FIG. 1 through FIG. 3, or operated similarly and a detail explanation thereof will be omitted.

EMBODIMENT 3

Figure 5:
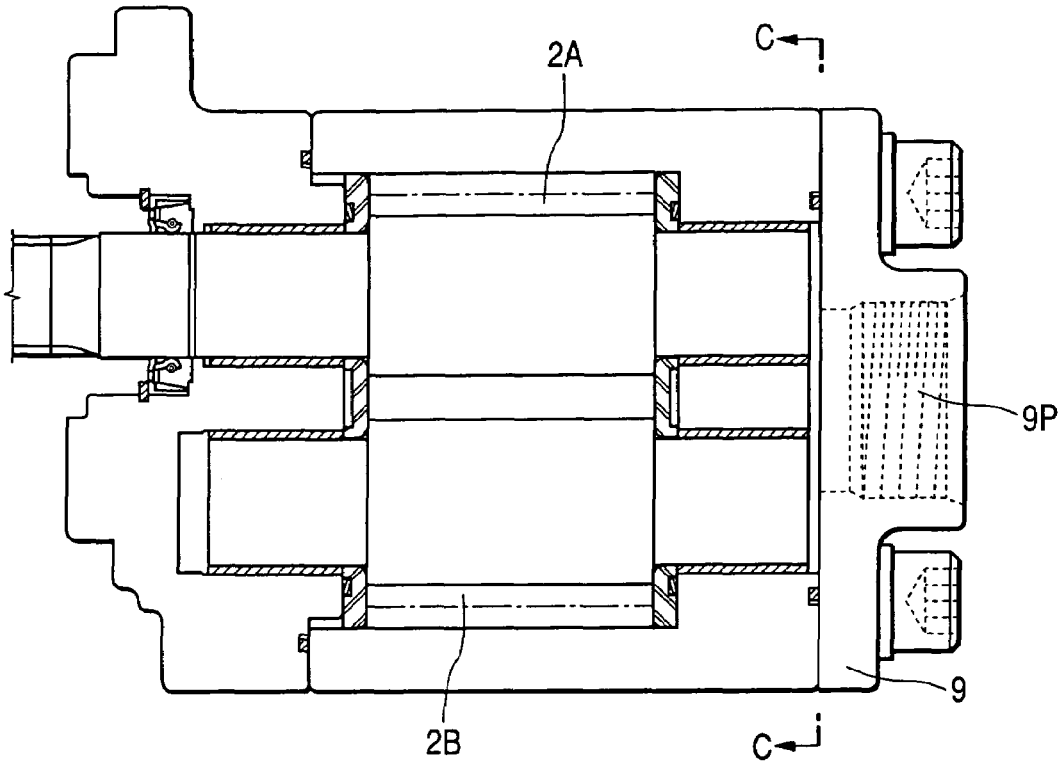
FIG. 5 is a vertical sectional view showing an embodiment of the invention.
Figure 6:
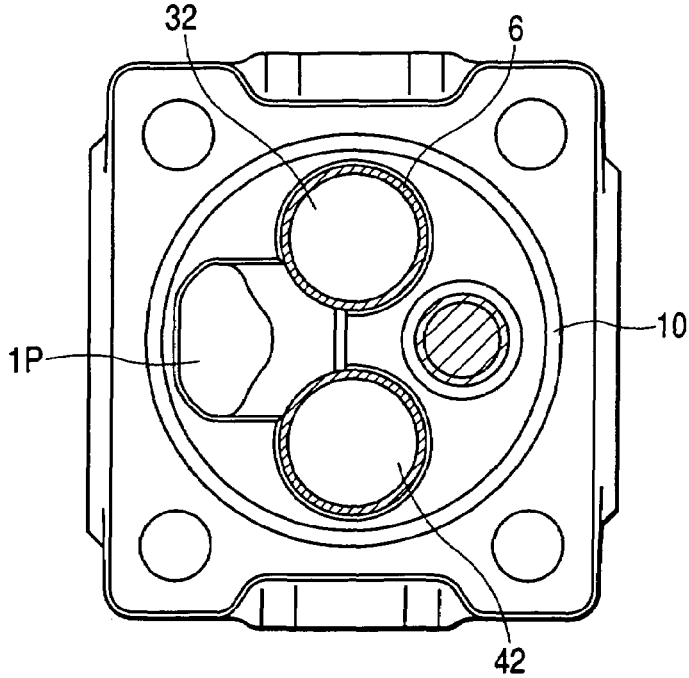
FIG. 6 is a vertical sectional view showing the constitution of the embodiment of the invention and is a view showing a C—C face of FIG. 5.
Figure 7:
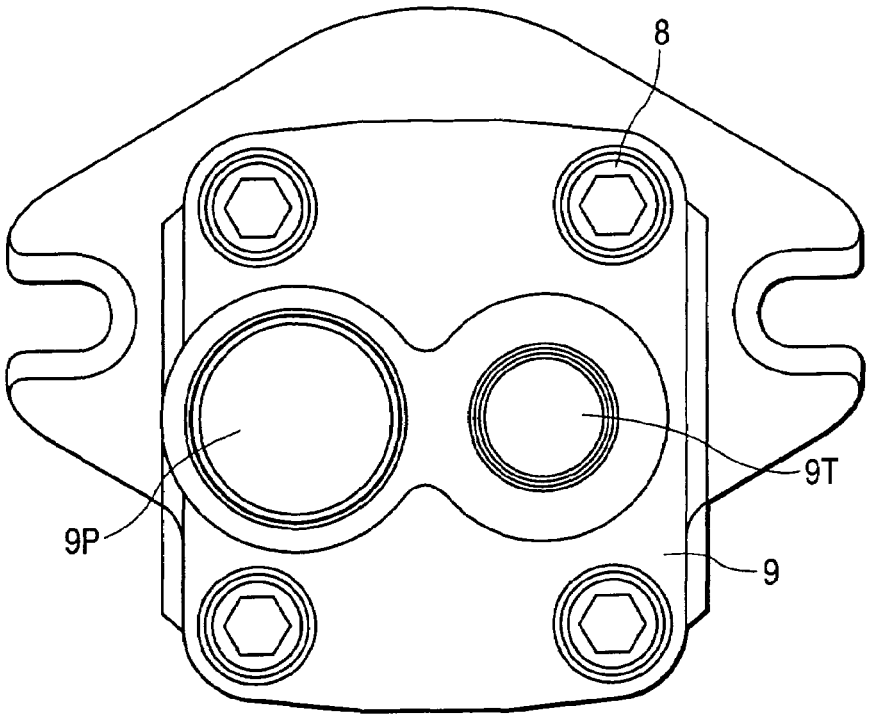
FIG. 7 is a side view showing the constitution of the embodiment of the invention and is a view viewing the constitution of FIG. 5 from a right side.

A third embodiment is characterized in the closing plate 5 for covering the rear face 1T of the rear shaft containing main body 1R. FIG. 5 through FIG. 7 show the embodiment. FIG. 6 shows a C—C face in FIG. 5, further, FIG. 7 shows a side view showing FIG. 5 from a right side. According to the embodiment, the closing plate 5 is constituted as a rear cover 9 having a function similar to that of the closing plate 5 and the rear cover 9 is provided with a suction port 9P. Further, the rear cover 9 is under low pressure except a delivery port portion 9T and therefore, the mechanical strength of the rear cover 9 may be reduced and light-weighted formation and a reduction in cost are achieved. Although the rear cover 9 is different from the 'closing plate' in expression thereof, the rear cover 9 is equivalent to the closing plate 5 specified in the scope of claims. Further, in FIG. 5 through FIG. 7, members of notations designated by notations the same as the notations in FIG. 1 through FIG. 3 are provided with functions the same as those of the members shown in FIG. 1 through FIG. 3 or operated similarly and a detail explanation thereof will be omitted.

EMBODIMENT 4

Figure 8:
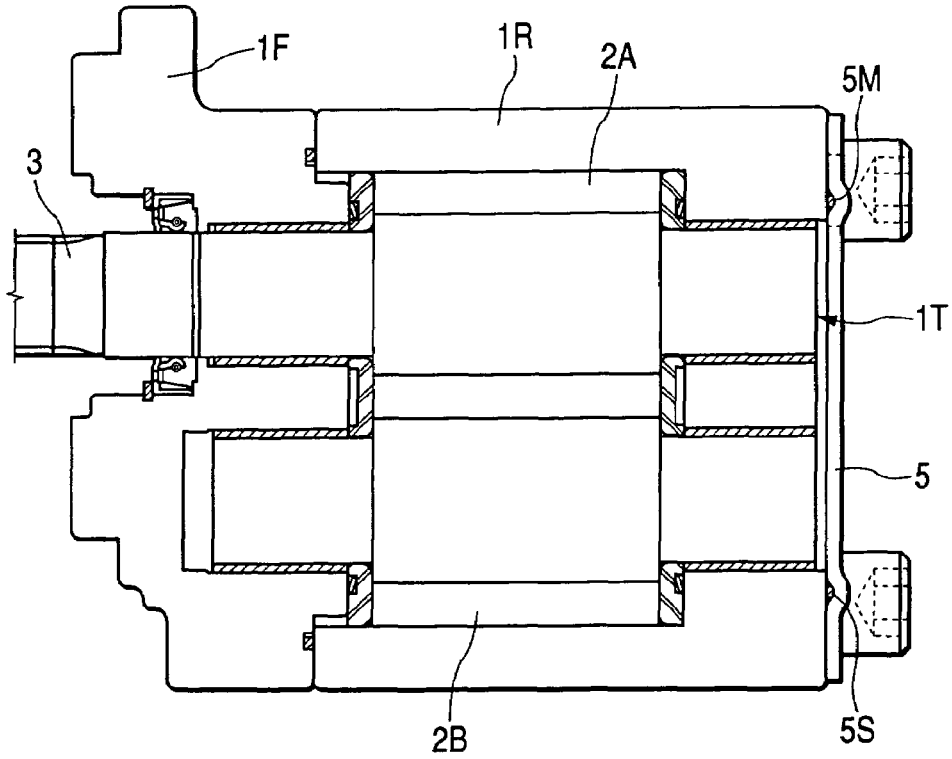
FIG. 8 is a vertical sectional view showing a constitution of an embodiment of the invention.

A fourth embodiment is shown in FIG. 8. The fourth embodiment is characterized in a constitution of forming a groove 5M for a seal member S at the closing plate 5 and inserting the seal member 5S to the groove 5M to couple. FIG. 8 is a vertical sectional view of the embodiment, the closing plate 5 is formed with the groove 5M in a ring-like shape and the groove 5M is inserted with the seal member 5S. In this case, it is not necessary to form the groove 5M at the rear face 1T of the gear•rear shaft containing main body 1R. Further, the shape of the groove 5M inserted with the seal member 5S is not limited to the circular shape but can be constituted by a rectangular shape, a trapezoidal shape or the like in accordance with shapes and arrangements of the shaft 3 and the low pressure region 1L (refer to FIG. 2). Further, the groove 5M can easily be formed by pressing by adopting a material capable of being pressed by pressing including iron or aluminum material for the closing plate 5.

The gear pump or motor provided by the invention is not limited to the above-described embodiment although the embodiment has been shown, but can be constituted by an example of integrating the gear containing main, body and the front shaft containing main body to be separate from the rear shaft containing main body, or a constitution in which the gear containing main body, the front shaft containing main body and the rear shaft containing main body are respectively separate from each other. Further, also the material is not limited to aluminum but the pump main body or the like can be made of cast iron and the invention includes all of the modified examples and other modified examples making full use of the characteristics of the invention.

What is claimed is:

1. A gear pump or motor comprising:

a pair of gears brought in mesh with each other;

shafts extending from front and rear sides of the gears in axis core directions of the respective gears;

a pump main body containing the gears and the shafts, the pump main body including a front shaft containing main body and a rear shaft containing main body, said front shaft containing main body having front bearing holes for containing and supporting the shafts on the front side of the gears and the rear shaft containing main body having rear bearing holes for containing and supporting the shafts on the rear sides of the gears, said front bearing holes being independent of said rear bearing holes, said rear shaft containing main body rear bearing holes penetrating a rear face of the rear shaft containing main body; and a closing plate attached to the rear face of the rear shaft containing main body to seal a rear face region of the rear shaft containing main body in an airtight fashion from outside, wherein the rear shaft containing main body rear bearing holes open into the rear face region, said rear face region also including surroundings of the rear bearing holes, wherein a hydraulic fluid is made to flow from a high pressure region to a low pressure region of a mesh portion of the two gears.

2. The gear pump or motor according to claim 1, wherein bushes are received in the front and rear bearing holes, and the bushes rotatably receive the shafts.

3. The gear pump or motor according to claim 1, further comprising:

a ring-like seal member interposed between the closing plate and the rear shaft containing main body for airtight sealing of the rear face region of the rear shaft containing main body.

4. The gear pump or motor according to claim 3, wherein bushes are received in the front and rear bearing holes, and the bushes rotatably receive the shafts, and wherein a further shaft is coaxially connected to one of the first and second shafts, said further shaft projecting from a front of the front shaft containing main body and serving as an input shaft for driving the gears when operated as a pump, and serving as an output shaft that is driven by the gears when operated as a motor.

5. A gear pump or motor comprising:

a pair of gears brought in mesh with each other;

shafts extending from front and rear sides of the gears in axis core directions of the respective gears;

a pump main body containing the gears and the shafts, the pump main body including a front shaft containing main body and a rear shaft containing main body, said front shaft containing main body having bearing holes for containing and supporting the shafts on the front side of the gears and the rear shaft containing main body having bearing holes for containing and supporting the shafts on the rear sides of the gears, said rear shaft containing main body bearing holes penetrating a rear face of the rear shaft containing main body; and a closing plate attached to the rear face of the rear shaft containing main body to seal a rear face region of the rear shaft containing main body in an airtight fashion from outside, wherein the rear shaft containing main body bearing holes open into the rear face region, said rear face region also including surroundings of the bearing holes, wherein a hydraulic fluid is made to flow from a high pressure region to a low pressure region of a mesh portion of the two gears, and wherein the rear shaft containing main body has a communicating hole communicating to a low pressure region, the communicating hole penetrating the rear face of the rear shaft containing main body and thereby establishing a passageway between said rear face region and said low pressure region whereby fluid flowing into said rear face region may flow to said low pressure region.

6. The gear pump or motor according to claim 5, wherein bushes are received in the bearing holes, and the bushes rotatably receive the shafts, and wherein a further shaft is coaxially connected to one of the first and second shafts, said further shaft projecting from a front of the front shaft containing main body and serving as an input shaft for driving the gears when operated as a pump, and serving as an output shaft that is driven by the gears when operated as a motor.

7. The gear pump or motor according to claim 5, wherein the rear shaft containing main body defines a communicating path for communicating fluid between the communicating hole and the bearing hole.

8. The gear pump or motor according to claim 7, wherein bushes are received in the bearing holes, and the bushes rotatably receive the shafts, and wherein a further shaft is coaxially connected to one of the first and second shafts, said further shaft projecting from a front of the front shaft containing main body and serving as an input shaft for driving the gears when operated as a pump, and serving as an output shaft that is driven by the gears when operated as a motor.

9. The gear pump or motor according to claim 1, further comprising:

a seal member interposed between the closing plate and the rear shaft containing main body for airtight sealing, wherein the closing plate has an inserting groove that receives the seal member.

* * * * *

UNITED STATES PATENT AND TRADEMARK OFFICE

CERTIFICATE OF CORRECTION

PATENT NO. : 7,150,612 B2
APPLICATION NO. : 10/854325
DATED : December 19, 2006
INVENTOR(S) : Komatsu et al.

It is certified that error appears in the above-identified patent and that said Letters Patent is hereby corrected as shown below:

Column 6, (Claim 1, Line 6), delete “including” and insert --consisting of--.

Column 6, (Claim 1, Line 12), after “gears”, insert --and a portion for containing said gears--.

Column 7, (Claim 5, Line 6), delete “including” and insert --consisting of--.

Column 7, (Claim 5, Line 12), after “gears”, insert --and a portion for containing said gears--.

Signed and Sealed this

Sixth Day of March, 2007

JON W. DUDAS
*Director of the United States Patent and Trademark Office*